US006026983A

United States Patent [19]

Graham

[11] Patent Number: 6,026,983

[45] Date of Patent: Feb. 22, 2000

[54] COMBINATION BEVERAGE SLEEVE AND COASTER

[75] Inventor: Gregory W. Graham, 45 Dormont Dr., Ormond Beach, Fla. 32176

[73] Assignees: Gregory W. Graham; Arthur W. Graham, both of Tampa, Fla.

[21] Appl. No.: 09/145,520

[22] Filed: Sep. 2, 1998

Related U.S. Application Data

[63] Continuation-in-part of application No. 08/931,375, Sep. 16, 1997.

[51] Int. Cl.[7] ..... B65D 3/04

[52] U.S. Cl. ..... 220/738; 220/739; 229/110

[58] Field of Search ..... 220/737, 739, 220/738; 229/117

[56] References Cited

U.S. PATENT DOCUMENTS

| | | | |
|---|---|---|---|
| D. 276,119 | 10/1984 | Heweston | D7/607 |
| D. 314,120 | 1/1991 | Rankin | D7/605 |
| D. 362,789 | 10/1995 | Sutton | D7/607 |
| 1,632,347 | 6/1927 | Pipkin . | |
| 1,891,892 | 12/1932 | Pipkin . | |
| 1,917,953 | 7/1933 | Davis . | |
| 2,058,915 | 10/1936 | Scholl | 215/100 |
| 2,071,399 | 2/1937 | Gambell | 65/53 |
| 2,081,409 | 5/1937 | Rush | 215/100 |
| 2,117,102 | 5/1938 | Pittler | 65/15 |
| 4,340,146 | 7/1982 | Stratton | 215/100.5 |
| 4,418,861 | 12/1983 | McFarland et al. | 229/110 |
| 4,432,488 | 2/1984 | Dutch | 229/110 |
| 4,648,528 | 3/1987 | Henderson | 220/739 |
| 4,838,466 | 6/1989 | Holmstrom | D7/605 X |
| 4,986,089 | 1/1991 | Raab | D7/607 X |
| 5,169,025 | 12/1992 | Guo | 220/739 |
| 5,445,315 | 8/1995 | Shelby | 229/117.06 |
| 5,845,806 | 12/1998 | Parchman | 220/739 |

*Primary Examiner*—Joseph M. Moy
*Attorney, Agent, or Firm*—Edward M. Livingston, Esq.

[57] ABSTRACT

A sleeve (1) for beverage containers (2) made of a substantially planar rigid material, such as cardboard, having side sections (6) which are foldably connected along folding creases (4) to form a sleeve having a top opening (3) for inserting a container. The sleeve has a bottom coaster (11) which is foldably connected to a bottom of one of the side sections which is supported by a strut (8) under the coaster adhesively attached at a folding tab (9) to the bottom of the coaster. An extension (7) on the coaster (11) is also provided to extend through a slit (18) in the folding strut for additional support. When the sleeve is assembled, the entire coaster (11) and strut (8) fold up into the body of the sleeve for easy storage and shipping. When the sleeve (1) contains a beverage container during use configuration, the coaster (11) covers the entire bottom of the sleeve, thereby preventing moisture from wetting or damaging a surface on which it is placed. The side sections (6) of the sleeve also serve as an excellent advertising medium.

22 Claims, 1 Drawing Sheet

COMBINATION BEVERAGE SLEEVE AND COASTER

CROSS REFERENCE TO RELATED APPLICATION

This is a continuation-in-part of Ser. No. 08/931,375, filed Sep. 16, 1997.

BACKGROUND OF THE INVENTION

1. Field

This invention relates to holders for beverage containers and more particularly to a sleeve with a built-in coaster for holding a beverage container while drinking.

Beverage containers, whether bottle or can, are often difficult and uncomfortable to hold, primarily due to condensation which forms on the outside and the temperature of the beverage. Further, unless such a bottle container is placed on a coaster, condensation from the container can leave a wet spot or otherwise damage a surface on which the container is placed. Moreover, condensation makes the beverage container slippery and unsafe to hold. Also, with cold beverages one desires to maintain the temperature of the drink as long as possible during drinking.

Currently, to overcome such problems, often people will take a napkin and wrap it around and under the beverage container. However, the napkin will usually not stay around the beverage container as it becomes wet and falls off or disintegrates. People also use insulated foam holders but such holders are expensive and are not collapsible for storage, shipping and handling. Therefore, a need exists for a beverage holder which solves the above problems.

2. Prior Art

The prior art includes many beverage holders but none just like the present invention. U.S. Pat. No. 5,445,315 issued to Shelby on Aug. 29, 1995, teaches a foldable and disposable sleeve holder with six (6) sides and a bottom tab to hold a can or a bottle during drinking. Unlike the present invention, Shelby uses insulation, has a bottom strut but no coaster and its holding tabs are attached differently. U.S. Pat. No. 2,081,409 issued to Rush on May 25, 1937, discloses a circular beverage holder with a bottom tab without a coaster and a slanted top. U.S. Pat. No. 2,071,399 issued to Gambell on Feb. 23, 1937, teaches a drinking glass protector with foldable, semi-circular halves and a circular bottom. U.S. Pat. No. 1,917,953 issued to Davis on Jul. 11, 1933, discloses an absorbent holder for a glass. U.S. Pat. No. 2,117,102 issued to Pittler on My 10, 1938, discloses a serving dish with a central octagonal glass holder. U.S. Pat. No. 2,085,915 issued to Scholl on Oct. 27, 1936, teaches a drip protecting holder for a bottle with a Velcro side seal and a bottom flap. U.S. Pat. No. 1,891,892 issued to Pipkin on Dec. 20, 1932, discloses a drip catching bottle holder consisting of a bag with a folded bottom. U.S. Pat. No. 1,632,347 issued to Pipkin on Jun. 14, 1927, discloses another drip catching bottle holder consisting of a paper bag or cup with apertures. U.S. Design Pat. No. 276,119 issued to Heweston on Oct. 30, 1984, shows a unitary collapsible insulating container which has a strut across the bottom, but no coaster covering the entire bottom of the sleeve. U.S. Design Pat. No. 362,789 issued to Sutton on Oct. 3, 1995, shows a two piece cake cooling pad designed to attach by VELCRO® around the sides and ends of a cake. U.S. Design Pat. No. 314,120 issued to Rankin on Jan. 29, 1991, shows a vacuum bottle caddy. U.S. Pat. No. 4,838,466 issued to Holmstrom on Jun. 13, 1989, teaches a collapsible holder for an aerosol dispenser. U.S. Pat. No. 4,986,089 issued to Raab on Jan. 22, 1991, discloses an insulating wrap which fits around the circumference of the beverage and is secured hook and loop holding material. However, it does not contain a coaster across the bottom thereof. Another beverage sleeve holder is shown in the above-referenced co-pending patent application; however, it does not have a coaster which collapses into the sleeve holder, which makes it easier and less expensive for shipping. Finally, U.S. Pat. No. 4,340,146, issued to Stratton on Jul. 20, 1982 teaches a moisture absorbent disposable coaster for a beverage container having a bottom and pleated sides that wrap around the lower sides of the container.

SUMMARY OF THE INVENTION

A primary object of the present invention is to provide a beverage container holder which eliminates condensation that forms on the outside of cold beverage containers, particularly in hot and humid climates.

Another object of the present invention is to provide such a beverage holder that shields a person's hand from the full effects of the temperature of the beverage, thereby making it more comfortable.

Another object of the present invention is to provide a beverage holder that also has a built-in coaster which covers the entire bottom of the holder in order to prevent damage to a surface on which a beverage is set.

A further object of the present invention is to help maintain the temperature of the beverage during drinking.

An even further object of the present invention is to provide such a beverage container holder that is collapsible thereby making it easier to ship, store and handle.

An additional object of the present invention is to provide a beverage container holder that serves as an advertising medium.

An even additional object of the present invention is to provide a beverage container that is inexpensive and biodegradable so that it is more readily disposable.

The present invention fulfills the above and other objects by providing a sleeve for a beverage container having a bottom portion with a plurality of side sections separated by folding creases running longitudinally from top to bottom, having an opening on the top sleeve for inserting a beverage container and a bottom coaster having the same shape as the opening in the bottom of the sleeve. The bottom coaster is foldably connected to a bottom of one of the side sections and has means for attaching and supporting it across the opening and the bottom of the sleeve. The means for attaching and supporting the coaster would preferably consist of a strut which is foldably connected to a bottom of the side section of the sleeve opposite the side section to which the coaster is attached. The supporting strut would have a cutout folding tab which is adhesively attached to the bottom of the coaster so that the coaster and strut fold together into the body of the sleeve in a flat configuration for easy shipping, storage and handling. The coaster may also have a tab extending from the distal end of the coaster which can be inserted into a slit in the proximal end of the strut to provide further support during use configuration. The sleeve would be preferably hexagonally shaped. Each side section of the sleeve could be used to display advertising. Although almost any rigid material could be used to make the present invention, the preferable material would be cardboard, which is lightweight. The cardboard could be waxed in order to better resist the effects of moisture.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
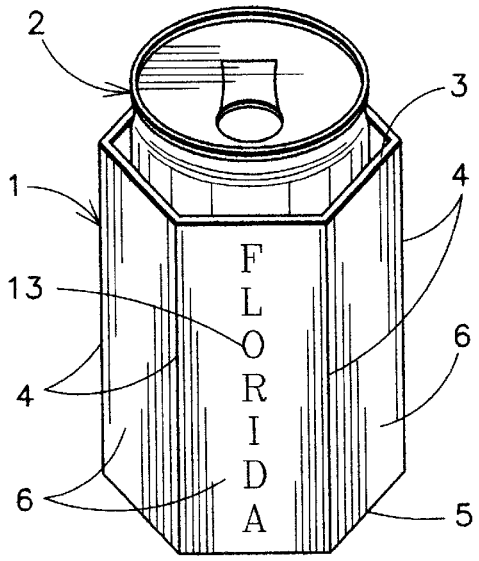
FIG. 1 is a perspective view of the sleeve of this invention holding a beverage container with advertising on one side section.

For purposes of describing the preferred embodiment, the terminology used in reference to the numbered components in the drawings is as follows:

| | | | |
|---|---|---|---|
| 1. | sleeve generally | 10. | side attachrnent tab |
| 2. | beverage can | 11. | coaster |
| 3. | top edge of sleeve | 12. | end side |
| 4. | folding creases | 13. | advertising |
| 5. | bottom edge of sleeve | 14. | coaster folding crease |
| 6. | side sections | 15. | cut in coaster attachment tab (9) |
| 6a. | coaster holding side | | |
| 7. | coaster tab | 16. | strut folding crea.se |
| 8. | coaster supporting strut | 17. | tab folding crease |
| 9. | coaster attachment tab | 18. | slit in strut |

Referring to the drawings, FIG. 1 shows the sleeve generally holding a beverage can 2. The sleeve 1 would preferably be hexagonally shaped for easy grasping. It would have a top edge 3, bottom edge 5 and each of the six sides 6 would be connected by folding creases 4.

Figure 2:
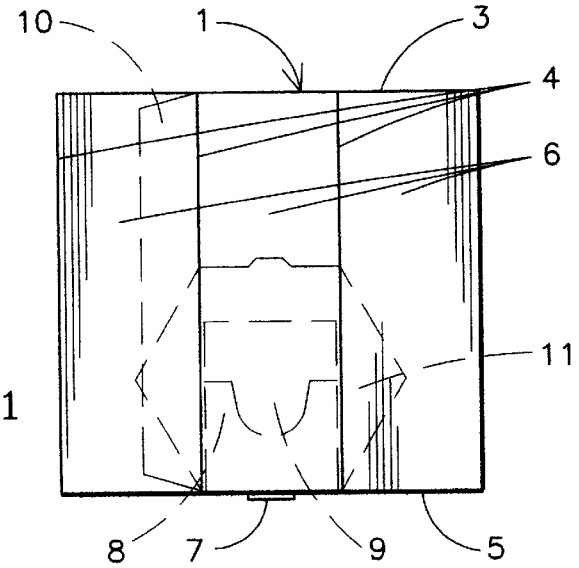
FIG. 2 is a side plan view of a hexagonal embodiment of the invention as it would appear in a flat unassembled configuration during storage and handling.

FIG. 2 shows the sleeve 1 in an unassembled state during shipping and handling. In this flat, unassembled configuration, the coaster 11 folds up into the sleeve 1 between the side sections 6, as does the supporting strut 8 and coaster attachment tab 9. The tab 9 is attached adhesively to the coaster. A tab 7 extends from a distal end of the coaster 11 to provide further support for the coaster 11 when in the use configuration shown in FIG. 3.

Figure 3:
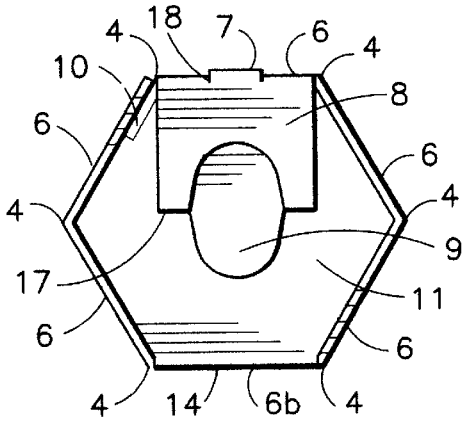
FIG. 3 is a bottom view of the sleeve in use configuration.

In FIG. 3 the coaster 11 is shown supported from the bottom by strut 8, which is attached by adhesive to the coaster 11 on tab 9. The coaster 11 is attached to the bottom of one of the sides 6 by folding crease 14. In addition to being supported by the strut 8, it would also provide further support for the beverage in the sleeve by use of an optional tab 7 which is inserted through a slit 18 in the strut 8.

Figure 4:
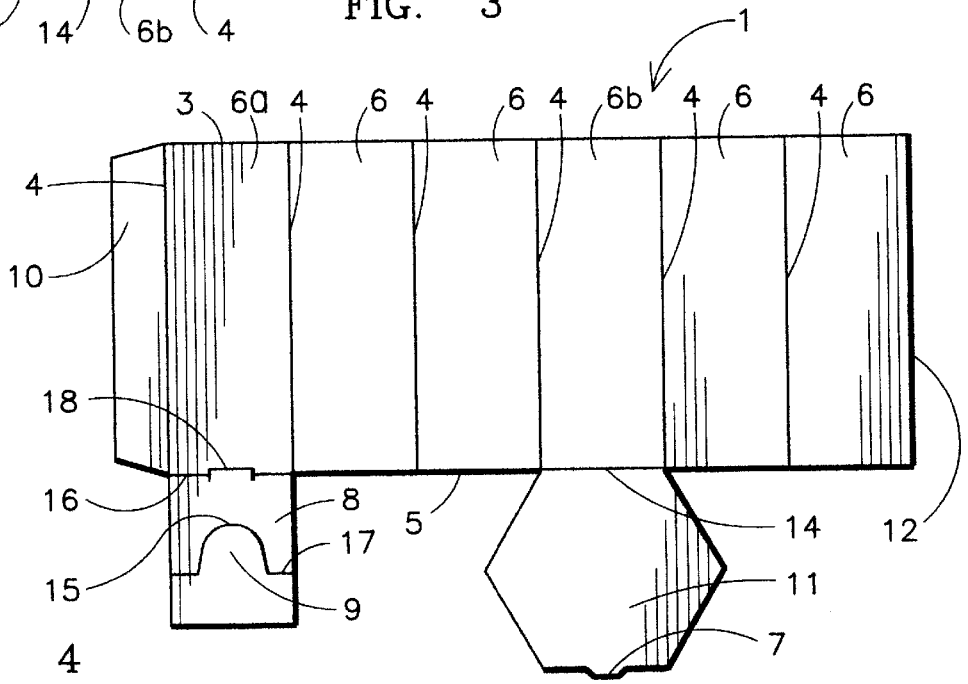
FIG. 4 is side view of the template of the sleeve of this invention before assembly into a sleeve.

In FIG. 4 the sleeve 1 is shown in a flat, unassembled state. The most pertinent features to point out in FIG. 4, which have not already been discussed, include that the coaster 11 is attached to the third side 6*b*, whereas the strut 8 is foldably connected to the sixth side 6*a* opposite the side 6*b* when the sleeve is in use configuration. Although the coaster 11 and strut 8 might be attached to any side, the attachment to sides 6*b* and 6*a*, respectively, as shown in FIG. 4 provides more strength for supporting the beverage container to be contained in the sleeve. Further, one side 6*a* has a attachment tab 10 which runs the length of one side 6. This tab is adhesively attached to one side, as shown in FIG. 3, so that it secures the sleeve 1.

Also in FIG. 4, the tab 9 on the supporting strut 8 is shown. When the tab 9 in use, it is cut along line 15 and folded along 17 when it is attached to the bottom of the coaster 11. In this manner it can be folded for use configuration as shown in FIG. 3 or when not being used the entire coaster and folder attached together can be folded the six sides in the sleeve 1 as shown in FIG. 2.

Thus, it should be readily apparent that the present invention provides a sleeve which yields a full coaster 11 to cover the entire bottom of the sleeve so the condensation or sweat from the bottom of any beverage container will not leave moisture on or damage wood any surface on which the sleeve containing a beverage is placed. The entire sleeve and coaster and its components would preferably be made of cardboard. The cardboard could also be waxed, particularly on inside surfaces making contact with the beverage container for increased durability. Although the sleeve could be made disposable, it could be used several times so long as it remains significantly strong enough to support a beverage container contained therein.

Although only a few embodiments of the present invention have been illustrated and described in detail hereinabove, all improvements and modifications to this invention within the scope or equivalents of the claims are covered by this invention.

Having thus described my invention, I claim:

1. A sleeve for a beverage container made from a substantially rigid planar material comprising:

a body portion having a plurality of side sections, separated by folding creases running longitudinally from a top to a bottom of the body portion, said body portion further having substantially circular openings on the top and the bottom, wherein one side section on the body portion has a tab for attaching said side section to an inside surface of another side section at an opposite end of the body portion to form the body portion of the sleeve;

the opening in the top of the sleeve having sufficient diameter for inserting the beverage container;

a bottom coaster having the same shape as the opening of the bottom of the sleeve, said coaster being foldably connected to a bottom of a side section; and means for attaching and supporting the coaster across the opening and the bottom of the sleeve, said means comprising a strut foldably connected at a proximal end to a bottom of a side section of the sleeve opposite the side section to which the coaster is foldably connected, said strut being attached to an underside of the coaster.

2. The sleeve for a beverage container of claim 1 further comprising a tab extending from a side of the coaster opposite the side section to which the coaster is foldably connected and a slit in the strut at a proximal end of the strut into which the tab on the coaster is inserted during use configuration.

3. The sleeve for a beverage container of claim 1 wherein the strut has a folding tab which is adhesively attached to the bottom of the coaster so that the coaster and strut together fold up and into the body of the sleeve in a flat configuration for easy shipping, storage and handling.

4. The sleeve for a beverage container of claim 2 wherein the strut has a folding tab which is adhesively attached to the bottom of the coaster so that the coaster and strut together fold up and into the body of the sleeve in a flat configuration for easy shipping, storage and handling.

5. The sleeve for a beverage container of claim 1 wherein the sleeve has six side sections to make it hexagonally shaped when in the use configuration.

6. The sleeve for a beverage container of claim 2 wherein the sleeve has six side sections to make it hexagonally shaped when in the use configuration.

7. The sleeve for a beverage container of claim 3 wherein the sleeve has six side sections to make it hexagonally shaped when in the use configuration.

8. The sleeve for a beverage container of claim 4 wherein the sleeve has six side sections to make it hexagonally shaped when in the use configuration.

9. The sleeve for a beverage container of claim 5 wherein at least one side section of the sleeve is used to display advertising.

10. The sleeve for a beverage container of claim 1 wherein at least one side section of the sleeve is used to display advertising.

11. The sleeve for a beverage container of claim 6 wherein at least one side section of the sleeve is used to display advertising.

12. The sleeve for a beverage container of claim 7 wherein at least one side section of the sleeve is used to display advertising.

13. The sleeve for a beverage container of claim 8 wherein at least one side section of the sleeve is used to display advertising.

14. The sleeve for a beverage container of claim 1 wherein the material is cardboard.

15. The sleeve for a beverage container of claim 2 wherein the material is cardboard.

16. The sleeve for a beverage container of claim 4 wherein the material is cardboard.

17. The sleeve for a beverage container of claim 5 wherein the material is cardboard.

18. The sleeve for a beverage container of claim 14 wherein the cardboard is waxed on at least an interior surface which makes contact with the beverage container.

19. The sleeve for a beverage container of claim 1 wherein the cardboard is waxed on at least an interior surface which makes contact with the beverage container.

20. The sleeve for a beverage container of claim 15 wherein the cardboard is waxed on at least an interior surface which makes contact with the beverage container.

21. The sleeve for a beverage container of claim 16 wherein the cardboard is waxed on at least an interior surface which makes contact with the beverage container.

22. The sleeve for a beverage container of claim 17 wherein the cardboard is waxed on at least an interior surface which makes contact with the beverage container.

* * * * *